US005899042A

United States Patent [19]

Pellock

[11] Patent Number: 5,899,042

[45] Date of Patent: May 4, 1999

[54] CROSS BRACE

[75] Inventor: Michael A. Pellock, Edwardsville, Ill.

[73] Assignee: MiTek Holdings, Inc., Wilmington, Del.

[21] Appl. No.: 09/041,203

[22] Filed: Mar. 12, 1998

[51] Int. Cl.[6] ..... E04C 3/07

[52] U.S. Cl. ..... 52/696; 52/693; 52/690; 52/712

[58] Field of Search ..... 52/690, 731.7, 52/317, 696, 712, 693

[56] References Cited

U.S. PATENT DOCUMENTS

| | | | |
|---|---|---|---|
| 3,503,173 | 3/1970 | Jureit | 52/644 |
| 3,708,942 | 1/1973 | Leonard | 52/694 |
| 4,078,352 | 3/1978 | Knowles | 52/693 |
| 4,207,719 | 6/1980 | Knowles | 52/693 |
| 4,295,318 | 10/1981 | Perlman | 52/693 |
| 4,541,218 | 9/1985 | Gottlieb | 52/694 |
| 4,561,230 | 12/1985 | Rionda | 52/289 |
| 5,024,039 | 6/1991 | Karhumaki | 52/735 |
| 5,592,800 | 1/1997 | Koo et al. | 52/692 |
| 5,606,837 | 3/1997 | Holizlander | 52/693 |

*Primary Examiner*—Carl D. Friedman

*Assistant Examiner*—Phi Dieu Tran A

*Attorney, Agent, or Firm*—Armstrong, Teasdale LLP

[57] ABSTRACT

A truss cross brace apparatus is described. The truss cross brace apparatus includes an elongated channel member having a U-shaped cross section. The channel member includes a base web and opposing side webs depending from the base web. An engaging portion extends from each end of the channel member. Each engaging portion includes at least one integrally formed tooth projecting from the bottom surface. The engaging portions are adapted to overlie the upper surfaces of the top chord of adjacent trusses, with the integral tooth embedded therein, such that an angle formed by the channel member and a top chord is about 45 degrees. A tab extends from a side web at one end and from the opposing web at the other end of the channel member. Each tab includes at least one integrally formed tooth projecting from the tab. Each tab is adapted to be bent to overlie the side surface of the top chord of adjacent trusses with the integral tooth embedded therein. The cross brace and support apparatus is quickly and easily installed between adjacent trusses without separate fasteners. The cross brace provides lateral support to the trusses during and after the construction process. Because the cross brace has a low profile, it can be left in place when sheathing is installed over the trusses.

20 Claims, 2 Drawing Sheets

CROSS BRACE

FIELD OF THE INVENTION

This invention relates generally to truss braces and more particularly, to a cross brace for lateral support of trusses.

BACKGROUND OF THE INVENTION

Premanufactured wooden trusses greatly facilitate the construction of buildings and other structures. Known trusses are essentially planar structures with spans and heights far exceeding their thickness. Trusses generally include a bottom chord, top chords extending angularly from the bottom chord, and webs between the top and bottom chords. Premanufactured trusses are very strong and reliable in service when properly braced.

During installation and use, however, the trusses can topple if they are not laterally braced. Typically, to prevent the trusses from toppling and after a plurality of trusses are positioned in place, lateral braces are attached to and extend perpendicularly across the top chords and/or the bottom chords of a number of trusses to maintain the spacing and position of the trusses. The lateral braces may, for example, be 2×4 boards nailed to the chords or metal bracing members commercially available from MiTek Industries, Inc. under the trademark THE STABILIZER, which is the subject of applicant's copending patent application (patent application Ser. No. 08/702,238, filed Aug. 27, 1996).

In addition to perpendicular lateral bracing, cross braces are desirably attached extending diagonally between adjacent trusses, typically at about a 45 degree angle. The cross braces work in conjunction with the perpendicular lateral bracing to provide lateral support to the trusses. Although the known cross braces provide adequate support for the trusses, such braces typically are not secured in place until a number of trusses have been located in position.

Further, as the trusses are tied together in the structure, for example by applying sheathing to the top chords, the known top chord cross braces must be removed in order to secure the sheathing. The temporary attachment and subsequent removal of the cross braces is time consuming and tedious. Moreover, this method provides no diagonal support after the braces are removed.

It would be desirable to provide permanent cross braces that can be easily and accurately installed diagonally between top chords, bottom chords, and/or webs of adjacent trusses during truss installation. It would also be desirable for the cross bracing to remain attached to the trusses, providing added lateral support, after installation of sheathing to the trusses.

SUMMARY OF THE INVENTION

These and other objects may be attained by a truss cross brace, sometimes referred to herein as a diagonal brace, configured to be installed diagonally between adjacent trusses. The cross brace may be quickly and easily installed and remains in place after construction, which eliminates the time consuming and tedious process of removing the cross braces when applying the sheathing over the trusses. Further, the cross brace may be installed as the trusses are located in position so that each truss may be laterally supported.

The truss cross brace, in one embodiment, includes an elongated channel member having a U-shaped cross section. The channel member includes a base web and opposing side webs depending from the base web. An engaging portion extends from each end of the base web. Each engaging portion includes at least one integrally formed nail like projection or tooth projecting from the bottom surface. The engaging portions are adapted to overlie the upper surfaces of the top chord of adjacent trusses, with the integral tooth embedded therein, such that the cross brace extends diagonally between adjacent trusses.

A first tab extends from one side web at one end of the cross brace. A second tab extends from the opposing side web at the opposite end of the cross brace. Each tab includes at least one integrally formed nail like projection or tooth projecting from the tab. Each tab is adapted to be bent to overlie the side surface of the top chord of adjacent trusses with the integral tooth embedded therein. The tabs lock the cross brace in position between the adjacent trusses.

At one end of the cross brace, the point at which the first tab extends from the side web and the end of the opposing side web define positioning or locating points. These locating points contact the side surface of the chord and are adapted to position the cross brace to extend diagonally from the chord. At the other end of the cross brace, the point at which the second tab extends from the side web and the end of the opposing side web also define positioning or locating points. These locating points are adapted to position the cross brace to extend diagonally from the chord of the adjacent truss.

The above described cross brace may be installed diagonally between adjacent trusses. Particularly, the engaging portion of one end of the cross brace is positioned over the upper surface of the top chord of a truss with the locating points contacting the side surface of the chord. The engaging portion is then secured by driving the integrally formed teeth into the upper surface of the chord. The tab is then secured by driving the integrally formed teeth into the side surface of the chord. The engaging portion of the opposite end of the cross brace is positioned over the upper surface of the top chord of an adjacent truss with the locating points contacting the side surface of the chord. The engaging portion is then secured by driving the integrally formed teeth into the upper surface of the chord. The tab is then secured by driving the integrally formed teeth into the side surface of the chord.

The cross brace is thus quickly and easily installed between adjacent trusses without separate fasteners. The cross brace may be installed as each individual truss is located in position. The cross brace provides lateral support to the trusses during and after the construction process. Because the cross brace has a low profile, it can be left in place when sheathing is installed over the trusses.

DETAILED DESCRIPTION

Figure 1:
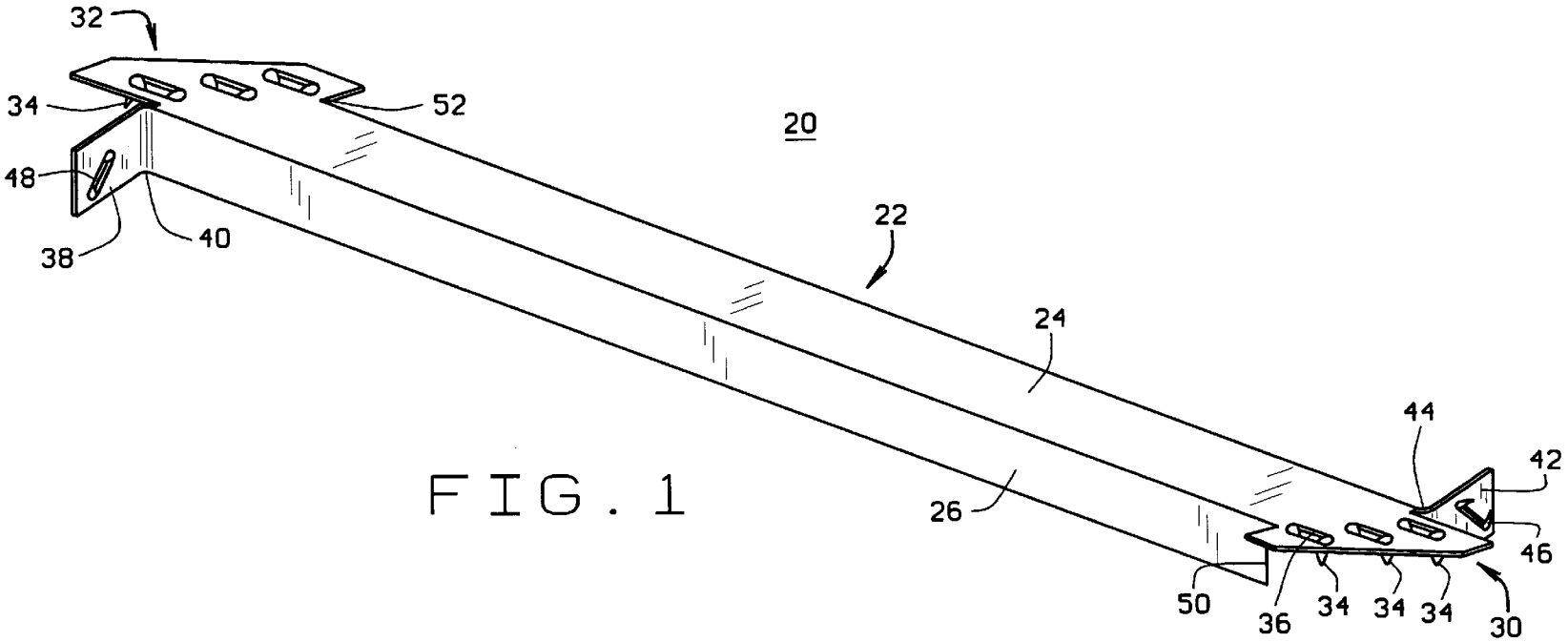
FIG. 1 is a perspective view of a cross brace in one embodiment of the present invention.
Figure 2:
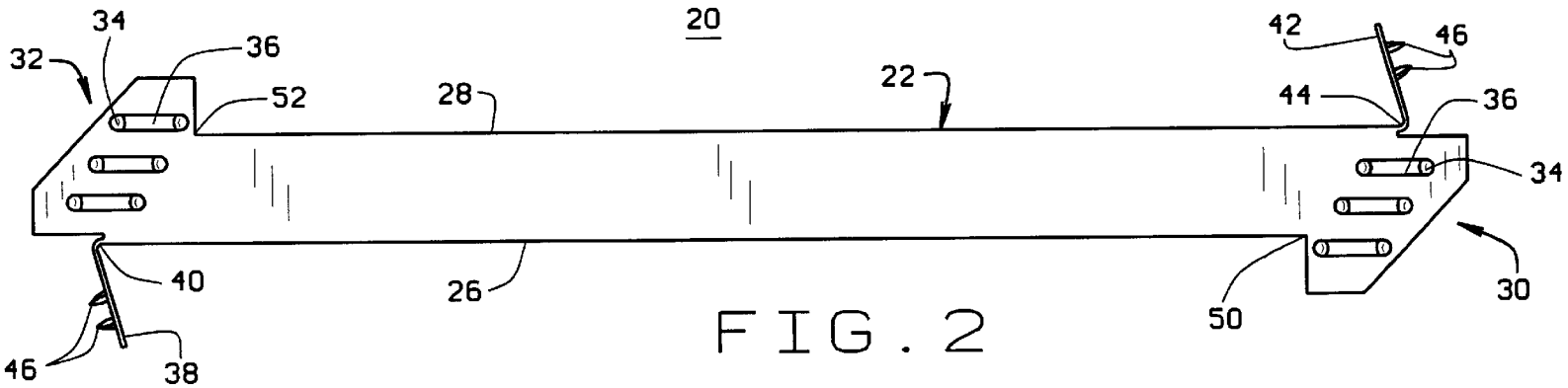
FIG. 2 is a top plan view of the cross brace illustrated in FIG. 1.

Referring to FIGS. 1 and 2, a truss cross brace 20, in accordance with an exemplary embodiment of the present invention, includes an elongated channel member 22 having a U-shaped cross-section. Channel member 22 includes a base web 24 and opposing side webs 26 and 28. Engaging portions 30 and 32 extend from each end of base web 24. Engaging portions 30 and 32 are generally flat and include at least one integrally formed nail like projection or tooth 34 projecting therefrom. Typically, pairs of teeth 34 are integrally formed in engaging portions 30 and 32 by conventional punching processes which leave an open slot 36 having a tooth 34 projecting down at each end of slot 36. The pairs of teeth 34 may be staggered with respect to each other to improve the ability to grip a wooden chord member. Typically, tooth 34 is an M18 tooth, which is well known in the art, but other sizes or types may be used.

Tab 38 extends from an end of side web 26 at fold line 40. Tab 42 extends from an end of side web 28 at fold line 44. Fold lines 40 and 44 are located at opposite ends of cross brace 20. Fold lines 40 and 44 permit tabs 38 and 42 respectively to be bent relative to channel member 22. Tabs 38 and 42 each include at least one integrally formed nail like projection or tooth 46 projecting outward. Typically, pairs of teeth 46 are integrally formed in tabs 38 and 40 as described above producing open slots 48 having a tooth 46 projecting from each end of slot 48. Tabs 38 and 42 are aligned or bent toward the opposite end of channel member 22 along fold lines 40 and 44 respectively such that projecting teeth 46 do not interfere with the positioning of cross brace 20 between adjacent trusses.

Typically, cross brace 20 is fabricated from sheet steel, for example 18 gauge galvanized steel. However, a different gauge steel or some other suitable material may be used to fabricate cross brace 20.

Figure 3:
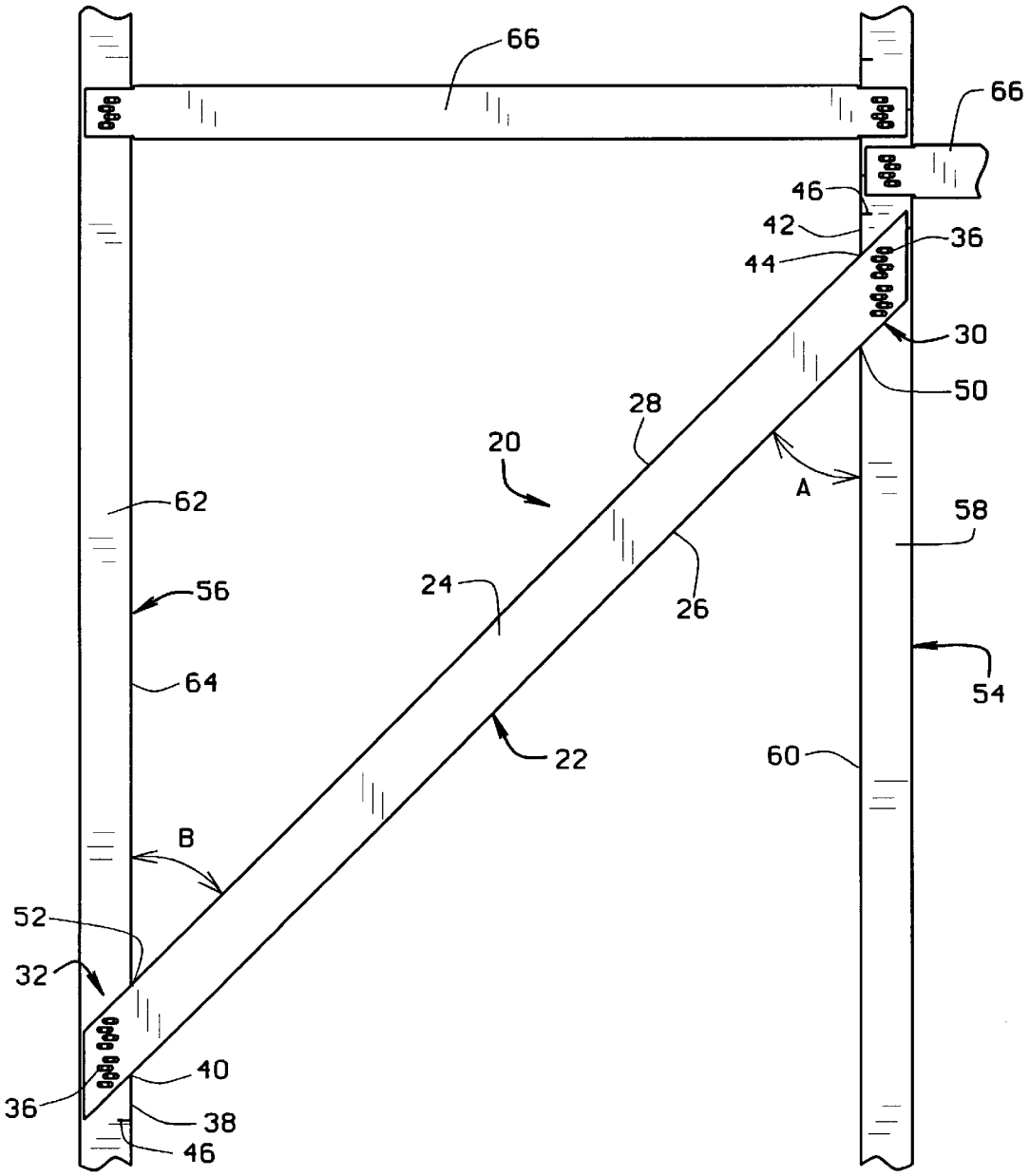
FIG. 3 is a fragmentary plan view of the cross brace illustrated in FIG. 1 positioned between two adjacent trusses.

FIG. 3 illustrates cross brace 20 positioned diagonally between and attached to a top chord 54 of a truss and a top chord 56 of an adjacent truss. Engaging portion 30 is adapted to overlie a top surface 58 of chord 54 such that cross brace 20 extends diagonally between chords 54 and 56. Teeth 34 projecting from slots 36 are embedded into top surface 58 of chord 54. Tab 42 is bent along fold line 44 to overlie a side surface 60 of chord 54 with teeth 46 embedded into side surface 60. Similarly, engaging portion 32 is adapted to overlie a top surface 62 of chord 56 such that cross brace 20 extends diagonally between chords 54 and 56. Teeth 34 projecting from the ends of slot 36 are embedded into top surface 62 of chord 56. Tab 38 is bent along fold line 40 to overlie a side surface 62 of chord 56 with teeth 46 embedded into side surface 60.

Side webs 26 and 28 are adapted to contact side surface 60 of chord 54 at fold line 44 on side web 28 and at end 50 of side web 26. Similarly, side webs 26 and 28 are adapted to contact side surface 64 of chord 56 at fold line 40 on side web 26 and end 52 of side web 28. Adapted as such, cross brace 20 extends diagonally between chords 54 and 56. Fold line 44 and end 50 at one end of cross brace 20 and fold line 40 and end 52 at the opposite end of cross brace 20 are positioning or locating points. These locating points enable quick, easy, and accurate positioning of cross brace 20 between chords 54 and 56.

When cross brace 20 is properly positioned between chords 54 and 56, an angle A, defined by side web 26 and side surface 60, and an angle B, defined by side web 28 and side surface 64, are acute angles. Of course mathematically, angle A will always equal angle B when chord 54 is positioned parallel to chord 56, which is normal building practice. In one embodiment, acute angles A and B are each equal to about 45 degrees.

A lateral support brace 66 extends perpendicularly between chords 54 and 56. One such lateral support brace 66 is described in U.S. patent Application Ser. No. 08/702,238, filed Aug. 27, 1996. Cross brace 20 works in conjunction with lateral support brace 66 and provides added lateral support to the adjacent chords.

In use, cross brace 20 is adapted to be installed diagonally between top chords 54 and 56 of adjacent trusses. Engaging portion 30 is positioned over top surface 58 of chord 54 with side webs 26 and 28 abutting side surface 60 of chord 54 at end 50 and fold line 44 respectively. Engaging portion 30 is then secured to top surface 58 by driving teeth 34 into top surface 58. Tab 42 is then secured by driving teeth 46 into side surface 60.

The other end of cross brace 20 is secured to chord 56 in the same manner. Engaging portion 32 is positioned over top surface 62 of chord 56 with side webs 26 and 28 abutting side surface 64 of chord 56 at fold line 40 and end 52 respectively. Engaging portion 32 is then secured to top surface 62 by driving teeth 34 into top surface 62. Tab 38 is then secured by driving teeth 46 into side surface 64.

As described above, FIG. 3 illustrates the installation of cross brace 20 diagonally between top chords 54 and 56 of adjacent trusses. Cross brace 20 may, however, be installed at many other locations. For example, cross brace 20 may be installed diagonally between the bottom chords of adjacent trusses. Cross brace 20 may also be installed diagonally between web members of adjacent trusses.

Cross brace 20, diagonally installed as described above to adjacent trusses, provides added lateral support to the trusses. Cross brace 20 may be diagonally installed as each individual truss is located in position. Because of a low profile, cross brace 20 can be left in place when sheathing is installed over the trusses.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. Accordingly, the spirit and scope of the invention are to be limited only by the terms of the appended claims.

I claim:

1. A cross brace apparatus for installation between adjacent trusses, wherein each truss comprises a plurality of chords having upper and side surfaces, said apparatus comprising:

an elongated channel member having first and second ends;

an engaging portion extending from each end of said elongated channel, said engaging portion comprising at least one integrally formed tooth projecting therefrom, said engaging portion adapted to overlie the upper surface of a chord with said integral tooth, embedded therein such that said cross brace extends diagonally from the chord; and a first tab extending from a side of said channel member at the first end and a second tab extending from the opposing side of said channel member at the second end, each of said tabs comprising at least one integrally formed tooth projecting therefrom, said tabs aligned sufficiently inward toward the opposite end of said channel member such that said integral tooth does not interfere with installation of said apparatus, and said tab adapted to be bent to overlie the side surface of the chord with said integral tooth embedded therein.

2. Apparatus in accordance with claim 1 wherein said channel member comprises a generally inverted U-shaped cross-section.

3. Apparatus in accordance with claim 2 wherein said channel member comprises a base web and opposing side webs depending from said base web, and wherein said first tab is connected to said side web at a fold line at the first end of said channel member and said second tab is connected to said opposing side web at a fold line at the second end.

4. Apparatus in accordance with claim 1 wherein said integrally formed tooth on said engaging portion comprises at least one pair of teeth punched from each engaging portion.

5. Apparatus in accordance with claim 1 wherein said integrally formed tooth on said tab comprises at least one pair of teeth punched from each tab.

6. Apparatus in accordance with claim 3 wherein said opposing side webs are adapted to contact the side surface of the chord at the fold line of one side web and at an end of the opposing side web, such that said cross brace extends diagonally from the chord.

7. A structure comprising a plurality of preformed trusses, each including a plurality of chords having upper and side surfaces, and a plurality of cross brace apparatus extending diagonally between adjacent trusses, each said cross brace apparatus comprising:

an elongated channel member having first and second ends;

an engaging portion extending from each end of said elongated channel, said engaging portion comprising at least one integrally formed tooth projecting therefrom, said engaging portion adapted to overlie the upper surface of a chord with said integral tooth embedded therein such that said cross brace extends diagonally from the chord; and a first tab extending from a side of said channel member at the first end and a second tab extending from an opposing side of said channel member at the second end, each of said tab comprising at least one integrally formed tooth projecting therefrom, said tabs aligned sufficiently inward toward the opposite end of said channel member such that said integral tooth does not interfere with installation of said apparatus, and said tabs adapted to be bent to overlie the side surface of the chord with said integral tooth embedded therein.

8. A structure in accordance with claim 7 wherein said channel member comprises a generally inverted U-shaped cross-section.

9. A structure in accordance with claim 8 wherein said channel member comprises a base web and opposing side webs depending from said base web, and wherein said first tab is connected to said side web at a fold line at the first end of said channel member and said second tab is connected to said opposing side web at a fold line at the second end.

10. A structure in accordance with claim 7 wherein said integrally formed tooth on said engaging portion comprises at least one pair of teeth punched from each engaging portion.

11. A structure in accordance with claim 7 wherein said integrally formed tooth on said tab comprises at least one pair of teeth punched from each tab.

12. A structure in accordance with claim 7 wherein said opposing side webs are adapted to contact the side surface of the chord at the fold line of one side web and at an end of the opposing side web, such that said cross brace extends diagonally from the chord.

13. A cross brace apparatus adapted for diagonal installation between adjacent trusses, wherein each truss comprises a plurality of chords having upper and side surfaces, said apparatus comprising:

an elongated channel member having first and second ends;

an engaging portion extending from each end of said elongated channel, said engaging portion comprising at least one integrally formed tooth projecting therefrom; and a first tab extending from a side of said channel member at the first end and a second tab extending from the opposing side of said channel member at the second end, each of said tabs comprising at least one integrally formed tooth projecting therefrom, said tabs aligned sufficiently inward toward the opposite end of said channel member such that said integral tooth does not interfere with installation of said apparatus.

14. Apparatus in accordance with claim 13 wherein said engaging portion is adapted to overlie the upper surface of a chord with said integral tooth embedded therein such that said cross brace extends diagonally from the chord, and wherein said tab is adapted to be bent to overlie the side surface of the chord with said integral teeth embedded therein.

15. Apparatus in accordance with claim 13 wherein said channel member comprises a generally U-shaped cross-section.

16. Apparatus in accordance with claim 15 wherein said channel member comprises a base web and opposing side webs depending from said base web, and wherein said first tab is connected to said side web at a fold line at the first end of said channel member and said second tab is connected to said opposing side web at a fold line at the second end.

17. Apparatus in accordance with claim 13 wherein said integrally formed tooth on said engaging portion comprises at least one pair of teeth punched from each engaging portion.

18. Apparatus in accordance with claim 13 wherein said integrally formed tooth on said tab comprises at least one pair of teeth punched from each tab.

19. Apparatus in accordance with claim 16 wherein said opposing side webs are adapted to contact the side surface of the chord at the fold line of one side web and at an end of the opposing side web, such that said cross brace extends diagonally from the chord.

20. A method of assembling a structure comprised of a plurality of preformed trusses and a plurality of cross brace apparatus, wherein each truss comprises a plurality of chords having upper and side surfaces, and wherein the cross brace apparatus, having a first and a second end, comprises a base web and opposing side webs depending from the base web; an engaging portion extending from each end of the base web, the engaging portion comprising at least one integrally formed tooth projecting therefrom; and a first tab extending from a side web at the first end of the cross brace and a second tab extending from the opposing side web at the second end of the cross brace, each tab comprising at least one integrally formed tooth projecting therefrom, the tabs aligned sufficiently inward toward the opposite end of the base web such that the integral tooth does not interfere with installation of apparatus, said method comprising the steps of:

positioning the engaging portion of the first end of the cross brace over the upper surface of the chord of a truss, with the ends of the side webs abutting the side surface of the chord, wherein the side webs are adapted to contact the side surface of the chord such that the cross brace extends diagonally from the chord;

driving the tooth integrally formed in the engaging portion into the upper surface of the chord;

bending the tab such that the tab overlies the side surface of the top chord and driving the tooth integrally formed in the tab into the side surface of the chord;

positioning the engaging portion of the second end of the cross brace over the upper surface of the chord of an adjacent truss, with the ends of the side webs abutting the side surface of the chord, wherein the side webs are adapted to contact the side surface of the top chord such that the cross brace extends diagonally from the chord;

driving the tooth integrally formed in the engaging portion into the upper surface of the chord; and bending the tab such that the tab overlies the side surface of the chord and driving the tooth integrally formed in the tab into the side surface of the chord.

* * * * *